US007911308B2

(12) United States Patent
Rippel

(10) Patent No.: US 7,911,308 B2
(45) Date of Patent: Mar. 22, 2011

(54) LOW THERMAL IMPEDANCE CONDUCTION COOLED MAGNETICS

(76) Inventor: Wally E. Rippel, Altadena, CA (US)

( * ) Notice: Subject to any disclaimer, the term of this patent is extended or adjusted under 35 U.S.C. 154(b) by 43 days.

(21) Appl. No.: 12/324,724

(22) Filed: Nov. 26, 2008

(65) Prior Publication Data

US 2010/0127810 A1 May 27, 2010

(51) Int. Cl.

| | |
|---|---|
| ***H01F 27/28*** | (2006.01) |
| ***H01F 27/08*** | (2006.01) |
| ***H01F 27/06*** | (2006.01) |
| ***H01F 27/02*** | (2006.01) |
| ***H01F 17/04*** | (2006.01) |

(52) U.S. Cl. ..... 336/182; 336/61; 336/65; 336/96; 336/98; 336/179; 336/220; 336/221; 336/222

(58) Field of Classification Search ..... None
See application file for complete search history.

(56) References Cited

U.S. PATENT DOCUMENTS

| | | | | |
|---|---|---|---|---|
| 1,763,114 | A * | 6/1930 | Wermine | 336/84 R |
| 2,894,232 | A * | 7/1959 | Knobel | 336/90 |
| 2,948,930 | A | 8/1960 | Herbst | |
| 3,030,596 | A * | 4/1962 | Henry et al. | 336/61 |
| 3,240,848 | A * | 3/1966 | Burke et al. | 264/102 |
| 3,374,452 | A * | 3/1968 | Judd | 336/60 |
| 3,722,082 | A * | 3/1973 | Hoell | 29/605 |
| 3,731,243 | A | 5/1973 | Davis | |
| 3,903,223 | A * | 9/1975 | Van Der Hoek | 264/46.5 |
| 4,082,916 | A * | 4/1978 | Jaklic et al. | 174/524 |
| 4,281,706 | A | 8/1981 | Liebermann et al. | |
| 4,488,134 | A | 12/1984 | Pfeiffer | |
| 5,469,124 | A | 11/1995 | O'Donnell et al. | |
| 6,185,811 | B1 | 2/2001 | Perry | |
| 6,710,691 | B2 | 3/2004 | Yu et al. | |
| 6,885,268 | B2 * | 4/2005 | Choi | 336/57 |
| 6,954,010 | B2 | 10/2005 | Rippel et al. | |
| 6,998,950 | B2 | 2/2006 | Skibinski | |
| 7,023,312 | B1 | 4/2006 | Lanoue et al. | |
| 7,158,001 | B2 | 1/2007 | Matsutani et al. | |
| 7,369,024 | B2 * | 5/2008 | Yargole et al. | 336/61 |
| 2004/0012294 | A1 | 1/2004 | Rippel et al. | |
| 2005/0012581 | A1 * | 1/2005 | Ono et al. | 336/90 |
| 2006/0026820 | A1 | 2/2006 | Rippel et al. | |
| 2006/0200971 | A1 | 9/2006 | Lanoue et al. | |
| 2009/0128276 | A1 * | 5/2009 | Horowy et al. | 336/96 |

* cited by examiner

*Primary Examiner* — Anh T Mai
*Assistant Examiner* — Mangtin Lian
(74) *Attorney, Agent, or Firm* — Christie, Parker & Hale, LLP

(57) ABSTRACT

An apparatus for cost-effective and efficient cooling of an active element. The active element may be a magnetic element such as an inductor or a transformer having windings and a core. A thermally conductive vessel has a cavity that is adapted to conform to a surface of the active element, with a small gap remaining between the surface of the active element and the surface of the cavity. The winding is adapted to have a uniform surface, by utilizing an edge winding or a machined winding fabricated from an extruded tube. A thermally conductive encapsulant fills gaps in the apparatus to further improve cooling.

15 Claims, 8 Drawing Sheets

LOW THERMAL IMPEDANCE CONDUCTION COOLED MAGNETICS

BACKGROUND OF THE INVENTION

Power processing systems are used to provide electrical power to a broad variety of applications, from automobiles to zeppelins. In many if not all of these applications, the size and mass of the power processing system are among the first design considerations. For most power processing systems, overall size and mass are typically determined by magnetic components, such as transformers and inductors. If these magnetic components can be made smaller and lighter, then the overall systems in which they are included become smaller, lighter, and usually less expensive.

In turn, for both transformers and inductors, size and mass are generally based on thermal considerations. That is, as heat transfer is improved, size can be reduced, because winding current densities and core voltage can increase without excessively raising the temperature. Accordingly, substantial effort has been directed toward achieving efficient heat transfer between the winding and ambient and between the core and ambient.

In many conventional power processing systems, magnetic components are cooled by free-convection or forced-air cooling. In these systems, heat transfer is limited by the heat transfer coefficient of air, which is typically in the range of 0.4 to 0.8 $mW/cm^2/°$ C. for free convection and 1.0 to 3.0 $mW/cm^2/°$ C. for forced-air cooling.

In other conventional power processing systems that utilize liquid cooling (e.g., transformer oil), the heat transfer coefficient is typically improved by more than a factor of ten. While this enables the associated magnetic components to be significantly reduced in size, the inconvenience and economic cost of providing the liquid coolant flow frequently offsets this performance advantage. Furthermore, in cases where the coolant contacts only the outer surface of the winding, thermal resistance of the winding itself may become the limiting factor.

In power systems rated above about 50 kW, cooling the system frequently involves a cold-plate, which may be either forced-air or liquid-cooled. In such cases, a low thermal impedance path is desired between both the winding and the core to the cold plate. One of the key challenges in obtaining the low thermal impedance path is the relatively poor thermal conductivity of electrical insulation materials in the winding. Accordingly, any design which involves heat transfer to a base-plate should have relatively short heat flow paths through the electrical insulation.

In various systems including power processing systems, a potting material or other encapsulant is frequently used to encapsulate various types of components, as is well known to those skilled in the art of electrical and electronic packaging. One conventional method of potting includes the use of a potting cup, a mold, or some other vessel, into which the components to be protected are placed, and an encapsulant or potting compound such as an epoxy or resin is poured or injected into the vessel to cover the components. The potting compound is then cured and hardened. Such a potting compound can provide the internal components with varying degrees of protection from environmental contamination, electrical insulation, structural support, and a thermally conductive path from the component to ambient.

However, further improvement in the conduction of heat away from power processing systems and various other electrical and electronic components is desired.

SUMMARY OF THE INVENTION

The present invention provides for the efficient cooling of an element, for example, a magnetic element such as an inductor or transformer having windings and a core. Various aspects of the invention include reduced cost, reduced size, reduced mass, reduced heat load into surrounding air, and an improved capability to use high-flux density core materials, further reducing cost and size as compared to the prior art.

In one aspect, the invention provides a thermally conductive vessel, such as a potting cup, with a cavity that is adapted to conform to a surface of the element. The element is placed in the cavity, and due to the closely matching shape, a relatively small gap remains between the element and the thermally conductive vessel. A thermally conductive encapsulant, such as a resin or potting material fills the gap between the element and the vessel, further improving the cooling ability of the apparatus.

Another aspect of the invention provides a winding with a uniform surface, reducing the necessary size of the gap between the winding and the vessel. The winding with a uniform surface can be provided with an edge winding, fabricated by bending a rectangular metal bar around its short edge, or a machined winding, machined from an extruded metal tube.

These and other aspects of the invention are more fully comprehended upon review of this disclosure.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1A:
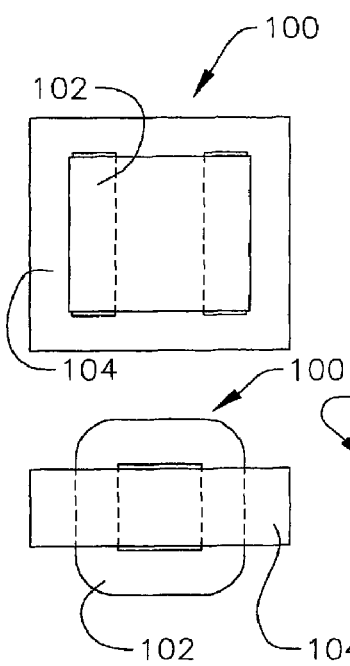
FIGS. 1A-1C illustrate a magnetic component and potting cup according to an exemplary embodiment of the present invention.

In the following detailed description, only certain exemplary embodiments of the present invention are shown and described, by way of illustration. As those skilled in the art would recognize, the invention may be embodied in many different forms and should not be construed as being limited to the embodiments set forth herein. Like reference numerals designate like elements throughout the specification.

Figure 1B:
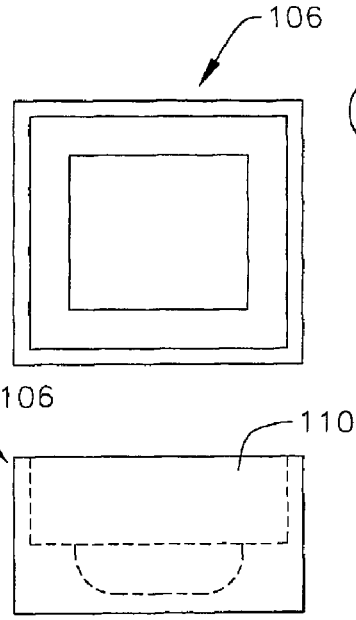
Figure 1C:
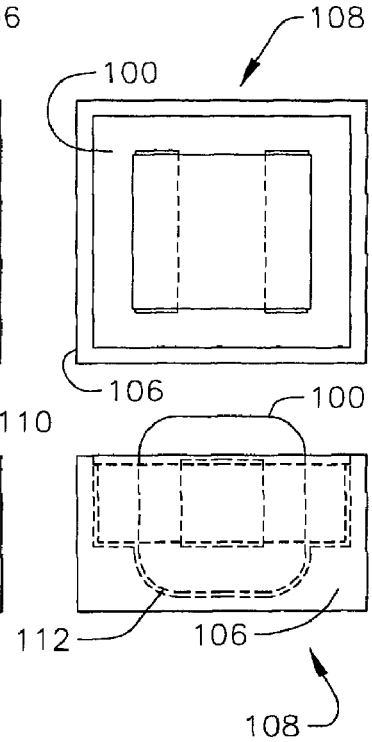

The present invention relates generally to a thermally conductive vessel that houses a component, where the thermally conductive vessel has an interior cavity that accurately conforms to the shape of corresponding surfaces of the component. FIGS. 1A-C illustrate an exemplary embodiment in which the component is an inductor 100 including a winding 102 and a core 104, and the thermally conductive vessel is a potting cup 106. FIG. 1A illustrates the inductor 100 including the winding 102 and the core 104 prior to insertion into the potting cup 106. FIG. 1B illustrates the potting cup 106 prior to the insertion of the inductor 100. FIG. 1C illustrates an assembled unit 108 including the inductor 100 inserted into the potting cup 106.

Those skilled in the art will comprehend that the invention is not limited to any particular element, and according to various embodiments the element is essentially any object that would benefit from a rapid transfer of thermal energy. For example, in some embodiments the element is a magnetic component such as a standard inductor 100, as illustrated in FIG. 1, a common-mode inductor, or a saturating reactor. In other embodiments, the magnetic component is a standard transformer, a fly-back transformer, or a voltage-regulating transformer. In the embodiments described below, for brevity the element will be described as including a magnetic core 104 and one or more windings 102. Furthermore, the thermally conductive vessel is not limited to a potting cup 106, or any other particular structure or material.

As illustrated in the embodiment of FIGS. 1A-C, for example, the thermally conductive vessel includes an interior cavity 110 that has a shape that is generally the inverse of the outer shape of the element to be inserted into the cavity 110. With this shape, after insertion of the element into the thermally conductive vessel, a small space or gap 112 remains between the interior surface of the vessel and the adjacent surfaces of the winding and the core. In general, to promote the conductance of heat away from the element, it is desirable that this gap is as small as possible. That is, limited in part by differences in thermal expansion of the element and the vessel, in general, the more accurately the shape of the cavity 110 in the thermally conductive vessel matches the shape of the corresponding surface of the element, the better.

The gap 112 between the element and the thermally conductive vessel is generally filled with a thermally conductive material such as a resin or other potting material. This resin provides a high thermal conductivity path from the element, such as the core 104 and the winding 102, to the thermally conductive vessel or potting cup 106. For example, some embodiments include a resin with a thermal conductivity that exceeds 0.5 W/(m·K).

Another aspect of the resin is the improvement in the strength and other mechanical properties of the structure. However, due to potential differences in thermal expansion of the element and the vessel, a resin that is very rigid might result in a structural failure. Thus, some embodiments of the invention include a resin that can be strained by at least 5% without yielding.

Accordingly, in the embodiment illustrated in FIG. 1, low thermal impedance paths are established between the winding 102 and the potting cup 106, and between the core 104 and the potting cup 106. The potting cup 106 serves to provide heat transfer, mechanical support for the magnetic components, and also serves to protect both the winding 102 and core 104 from environmental damage such as shock, vibration, and moisture.

Figure 2:
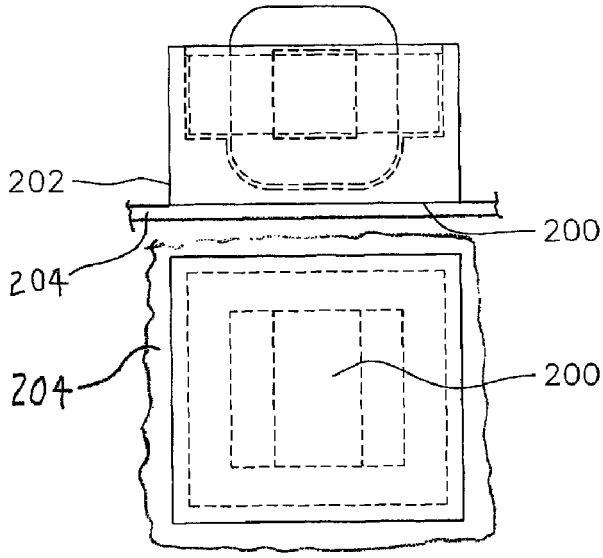
FIG. 2 illustrates an embodiment including a flat surface for making forced contact with a cold plate or heat sink.

Several further embodiments enable efficient heat removal from the vessel. A first embodiment, illustrated in FIG. 2 includes a flat surface 200, such as a bottom surface of the vessel 202 such that efficient heat transfer can be achieved when this surface 200 is brought into forced contact with the surface of a cold-plate or heat sink 204.

Figure 3:
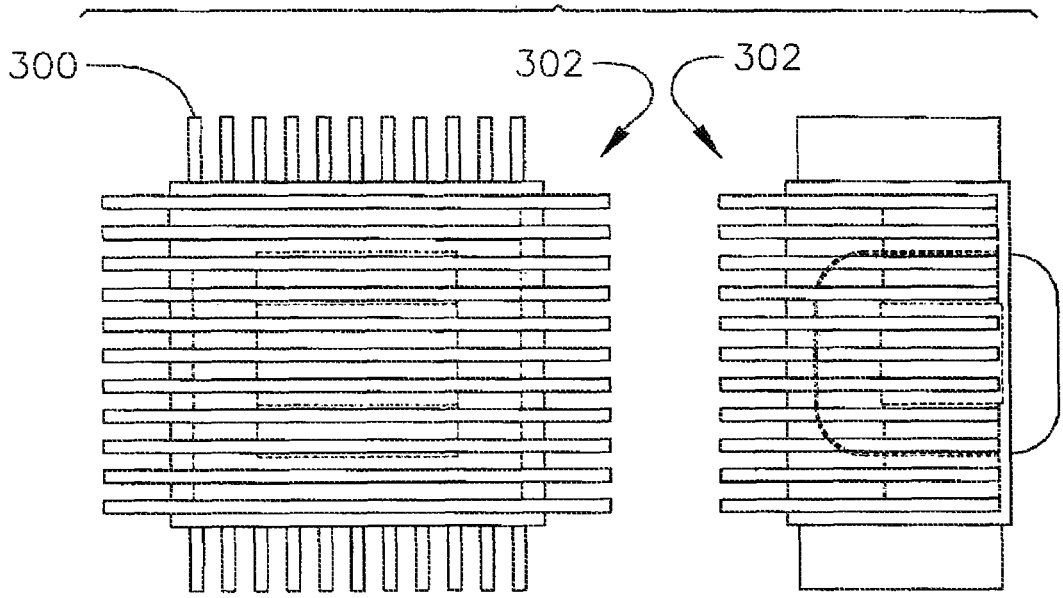
FIG. 3 illustrates an embodiment including external fins.

A second embodiment, illustrated in FIG. 3, includes external fins 300 on the vessel 302, such that either free-convection or forced-air cooling is enhanced. Variations of this embodiment include any number from one or more fins 300. Furthermore, the term "fins" is not intended to limit the shape or the structure in this embodiment, and generally refers to any shape or structure adapted to increase the surface area of the thermally conductive vessel.

Figure 4:
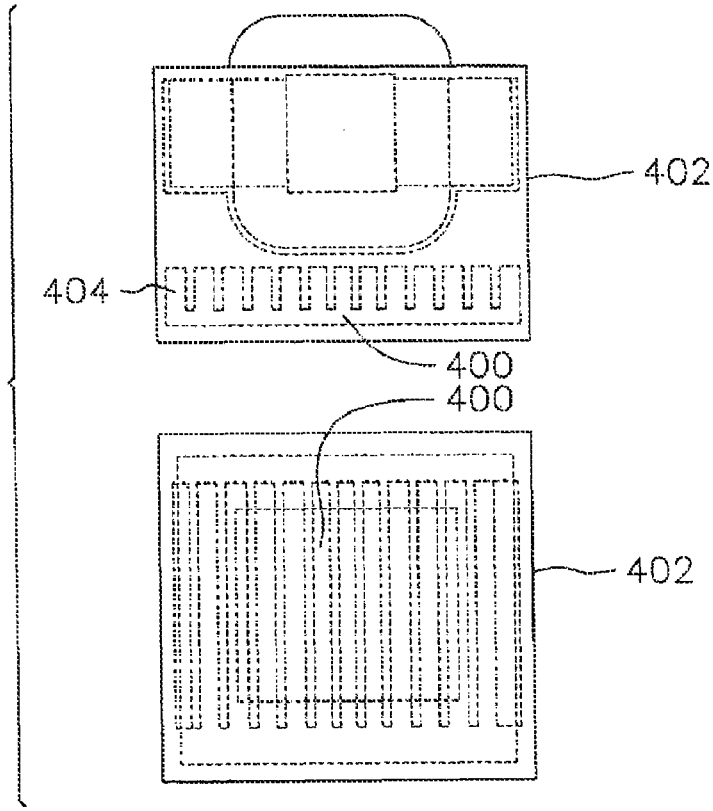
FIG. 4 illustrates an embodiment including a finned interior cavity.

A third embodiment, illustrated in FIG. 4, includes an internal cavity 400 in the thermally conductive vessel 402 for cooling with a circulating liquid coolant. In this embodiment, the liquid coolant is injected into the internal cavity 400 through an inlet and evacuated from the internal cavity 400 via an outlet (not illustrated). In a further embodiment, the internal cavity surfaces include fins 404 for further improving heat transfer.

When conventional windings are utilized in the embodiments illustrated in FIGS. 1-4, the efficiency of heat transfer out of the magnetic component (e.g., the inductor 100) may be less than desired. Further improvements to the overall heat transfer can be achieved in a magnetic component by configuring all elements of the winding for improved heat transfer to the winding surface.

A winding is a coil of conductive material, such as a metal, generally shaped as a circular helix. The helical shape functions to concentrate a magnetic field, generated by a current in the winding, through the center of the winding, and further, to increase the inductance of the winding material. Most conventional windings are formed of round or rectangular wire wound in multiple layers.

First, with a conventional winding, the topography of the outer surface of the winding is not smooth or accurately defined. Small variations in wire tension during a winding process and variations in insulation between layers can cause appreciable variations in the winding outer surface. Thus, for production designs utilizing a conventional winding, the gap between the winding surface and the corresponding surface of the potting cup must be made relatively large. This in turn reduces the heat transfer between the winding and the potting cup. Second, electrical insulation between layers of the winding further reduces heat transfer. In particular, the innermost layers of the winding utilize a heat flow path including all of the insulating layers external to those innermost layers. Third, achieving the winding termination is generally difficult, especially where the conductor cross section is large.

Figure 5:
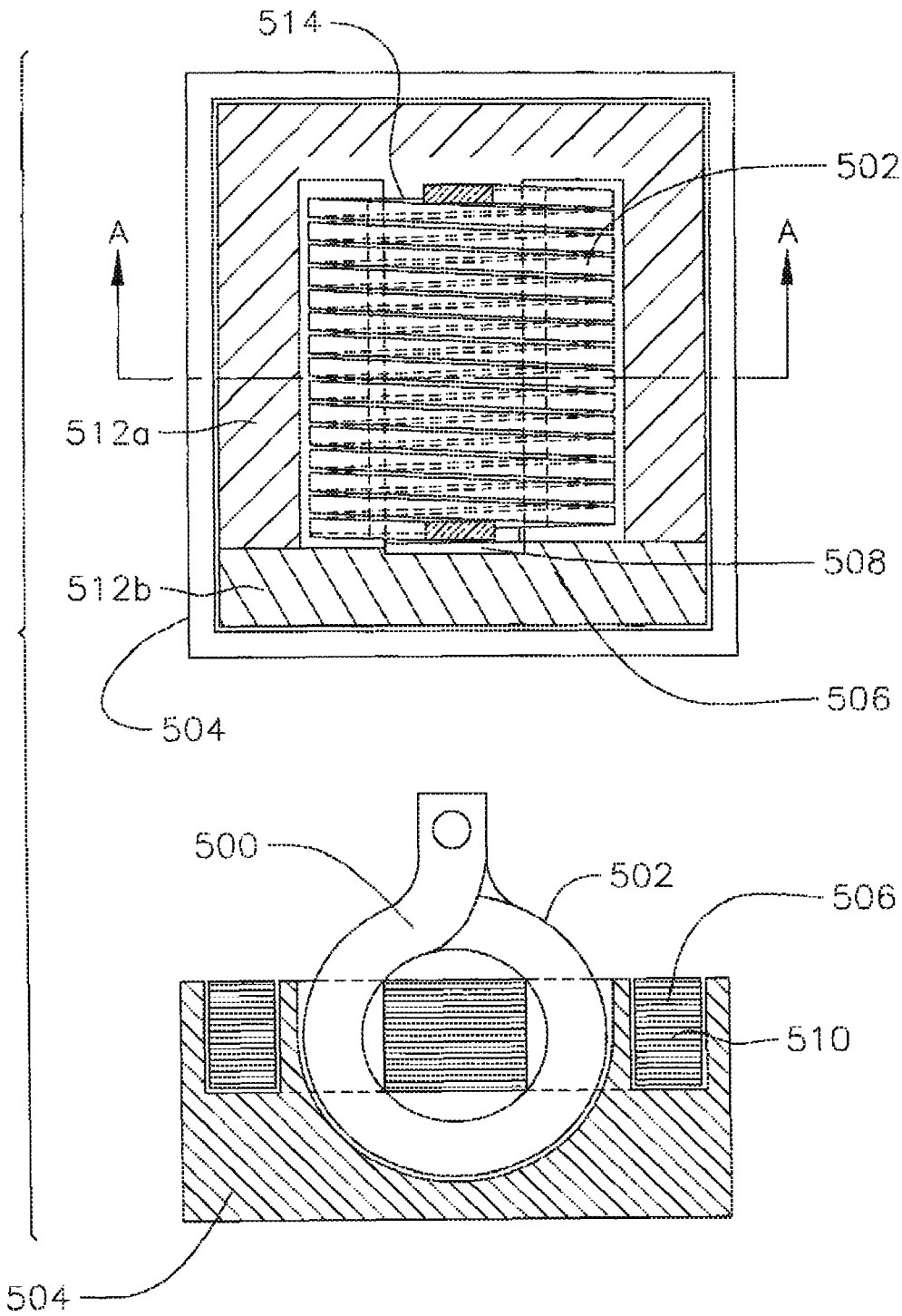
FIG. 5 illustrates an embodiment including a magnetic element having a laminated E-I core and an edge winding.

Thus, some embodiments of the present invention utilize an edge winding 500, as illustrated in FIG. 5. Generally, an edge winding 500 is a rectangular conductor wound on its narrow edge. In one embodiment, an edge winding 500 includes a conductor having a generally uniform rectangular cross-section where the thickness dimension is less than the width dimension, and where the axis of bending is parallel to the thickness dimension. Such edge windings 500 can be made utilizing conventional coated copper, coated aluminum strip materials, or other suitable materials using appropriate winding machines. An edge winding 500 may provide an outer surface 502 that is a circular cylinder having generally uniform and precise dimensions. This enables efficient heat transfer when applied to a magnetic component having an edge winding 500 and a magnetic core 506, incorporated into a vessel 504 having internal surfaces that accurately conform to the edge winding surfaces.

Figure 6:
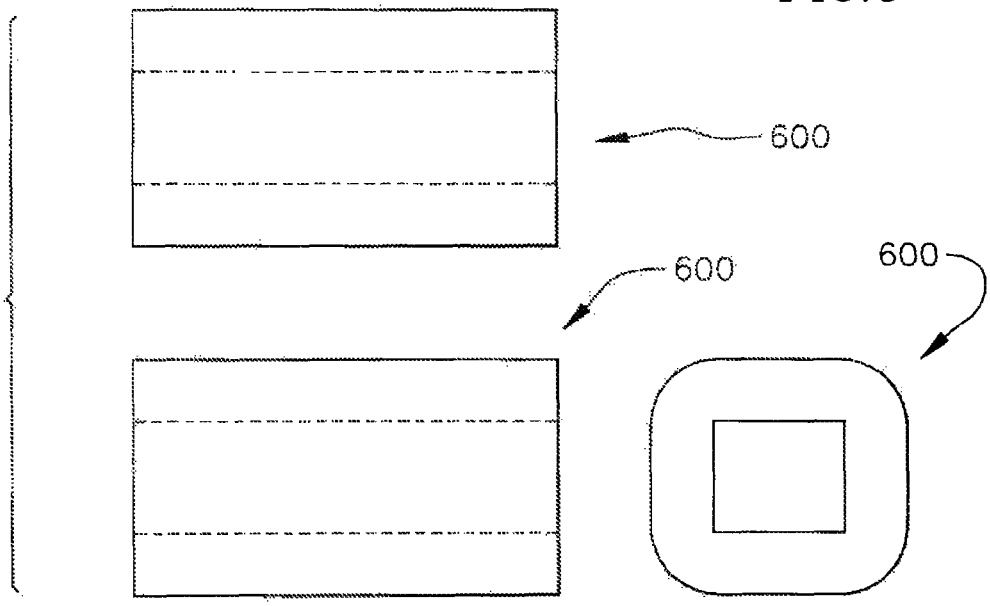
FIG. 6 illustrates an extruded metal tube.

Still other embodiments utilize a different winding structure, which brings benefits to a system in which a relatively large conductor cross-section and a relatively small number of turns are desirable. According to these embodiments, an extruded tube 600 made of aluminum, copper, or another suitable material as illustrated in FIG. 6 is machined to create both the machined winding 700 and the associated terminals 704. For example, as detailed in Davis, U.S. Pat. No. 3,731,243, four cuts on an extruded tube 600 using properly angled, ganged, circular saws provides the required spiral slitting 702, while conventional milling removes material adjacent the terminals 704. The machined winding element 700 can be anodized or coated to provide needed electrical insulation.

Figure 7:
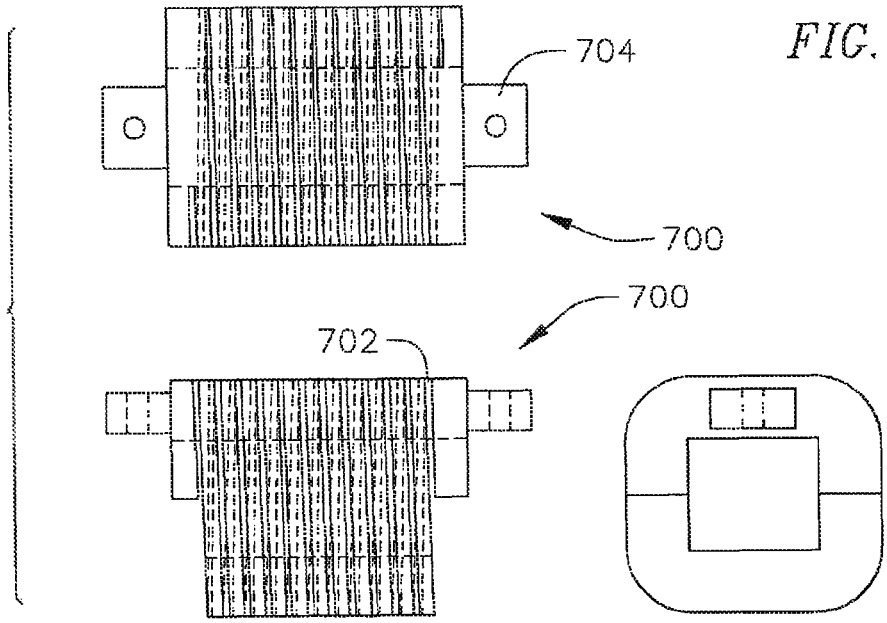
FIG. 7 illustrates a machined winding including terminals and coils.

A machined winding 700 as illustrated in FIG. 7 enables a higher ratio of the width to the thickness of the conductor than possible with an edge winding 500. Further, dimensional tolerances of the machined winding 700 can be made very precise. Manufacturing is made more flexible because windings 700 of various turn numbers and lengths can be made using the same tube stock. And the end terminals 704 of the machined winding 700 are generally of superior strength and rigidity. That is, because the termination 704 is an integrated part of the machined winding 700, there is no need for separate terminals to be attached to the machined winding 700. This adds reliability, while reducing manufacturing costs.

Figure 8:
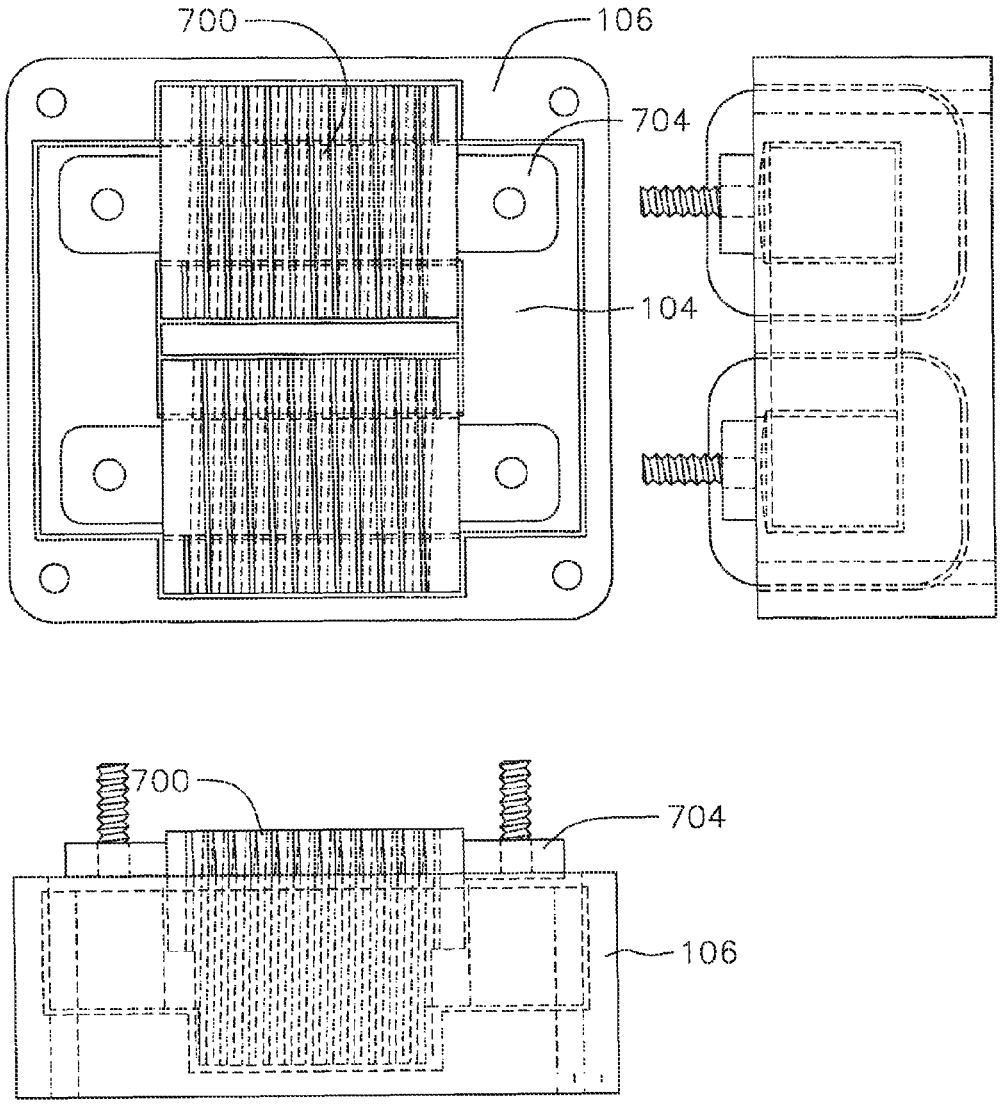
FIG. 8 illustrates an exemplary embodiment including a U-I core and two machined windings.

Moreover, unlike an edge winding 500, because a machined winding 700 is constructed from an extruded tube 600, the inner and outer surfaces are not constrained to be round, or any other shape. As illustrated in FIG. 8, this enables the profile of the machined winding 700 to conform to the shape of a magnetic core 104 having essentially any shape, thus reducing or eliminating dead space between the winding 700 and core 104 when non-circular cores are used, such as the rectangular-cross-section core 104.

Figure 9:
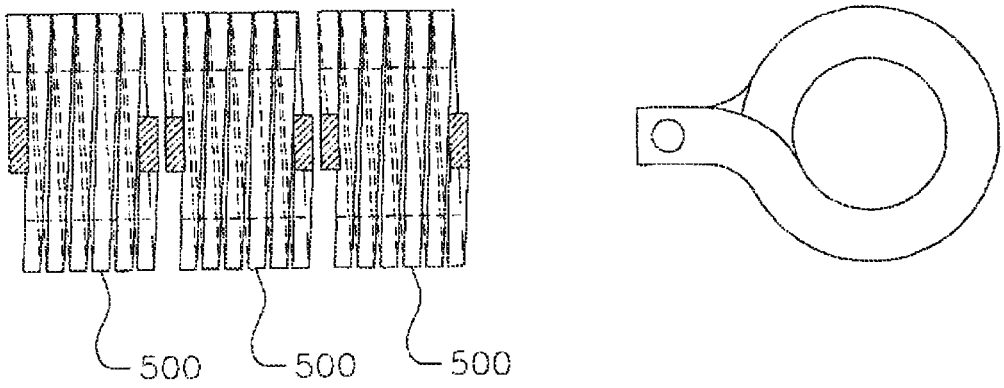
FIG. 9 illustrates three axially adjacent edge windings.

In some embodiments of the invention, a plurality of individual edge windings 500 or machined windings 700 are generally aligned in an axial direction, as illustrated in FIG. 9. This way, transformers with multiple primary and secondary windings can be structured using a rectangular conductor of uniform width and varying thicknesses. Some variations of these embodiments include transformers with at least partially interleaved primary and secondary windings, reducing the leakage inductance between any two windings.

In embodiments already discussed such as that illustrated in FIG. 5, where the edge winding 500 is a single layer, inter-layer insulation may be eliminated. Utilization of single-layer edge windings 500 may save cost, improve the packing factor, and eliminate the associated component of thermal resistance. The same principle applies to embodiments having a single-layer machined winding 700.

Figure 10:
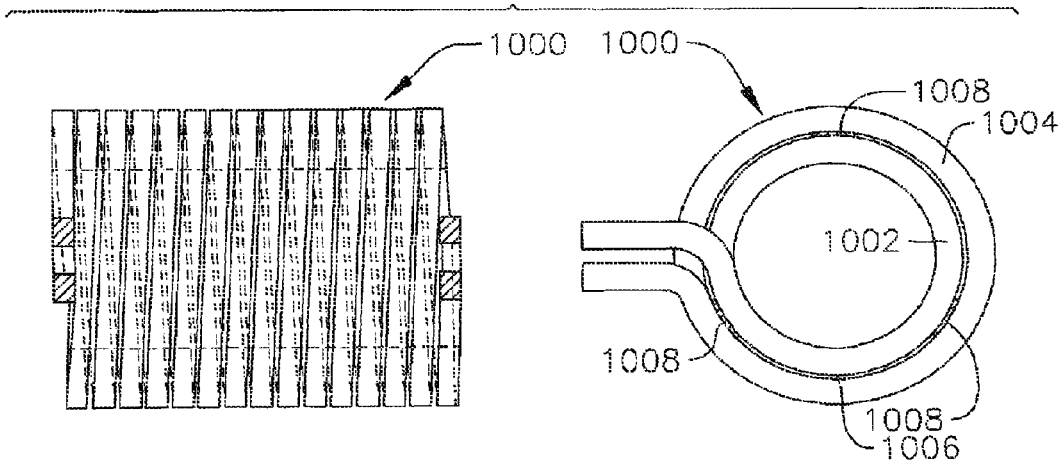
FIG. 10 illustrates a two-element double layer concentric edge winding.
Figure 11:
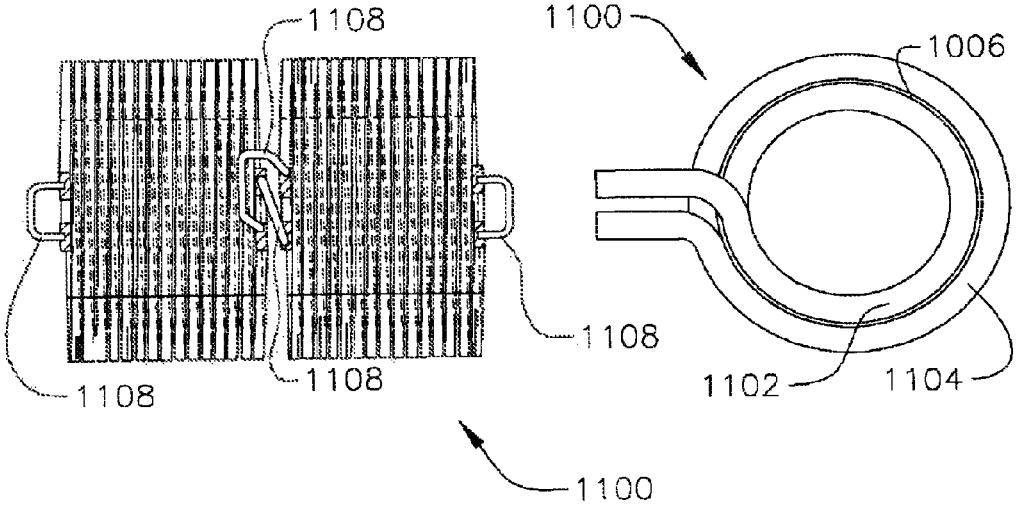
FIG. 11 illustrates a four-element double layer edge winding with transposed wiring.

However, other design considerations may result in the favorability of embodiments including concentric windings 1000, 1100 as illustrated in FIGS. 10-11. In these embodiments, a small space or gap 1006 remains between the inner winding 1002, 1102 and the outer winding 1004, 1104. When the gap 1006 between respective windings is relatively small and is uniformly filled with a thermally conductive resin, good heat transfer can be achieved for all elements of the winding. Some embodiments further include spacers 1008 between the windings, for facilitating concentric alignment of the individual windings.

As already discussed, various embodiments of the invention include a magnetic core 104, as conventionally utilized in a variety of applications known to those skilled in the art. Returning to FIG. 5, the magnetic core 104 may include stacked laminations 510, which are electrically insulated from one another to reduce or prevent eddy currents, and may be made of steel, iron, or another suitable material. Alternatively, the core may be structured from a ferromagnetic powder, or a sintered ceramic material.

Embodiments of the invention can include E-E or E-I core elements 512*a*, 512*b*, as illustrated in FIG. 5, both known to those skilled in the art. In these cases, windings 500 can be placed on just one prong 514, or on two or three of the prongs (not illustrated). In particular, for three-phase applications, it often makes sense to use E cores where all three prongs 514 have the same dimensions and where windings 500 are applied to each prong 514. All of these schemes can be structured with conventional windings, machined windings 700, or edge windings 500 as illustrated in FIG. 5, where the potting cup 106 conforms to the winding 102 and core 104 surfaces.

Figure 12:
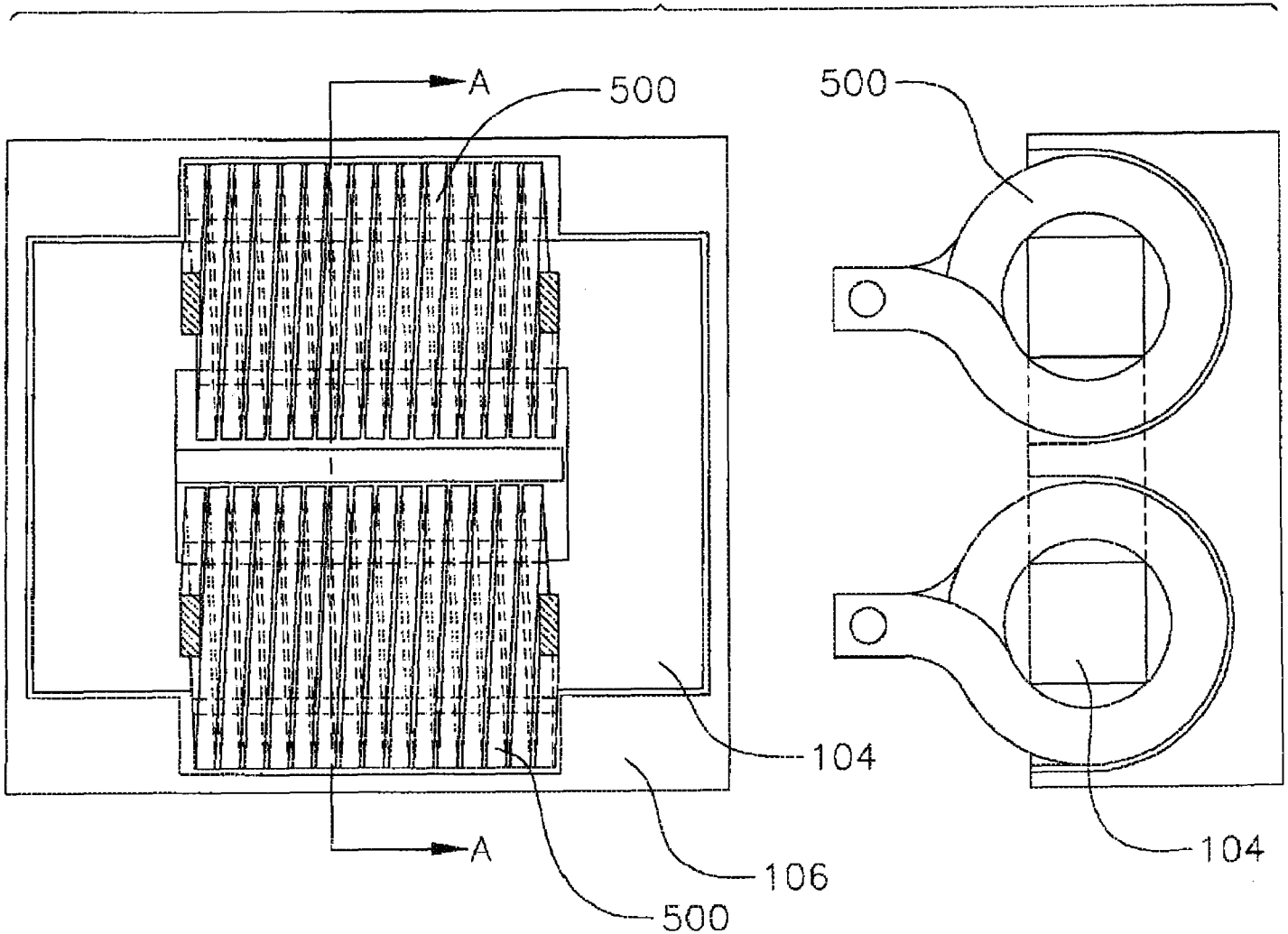
FIG. 12 illustrates an embodiment including a U-I core and two edge windings.

Embodiments of the invention can include U-U or U-I cores, known to those skilled in the art, as illustrated in FIG. 12. These embodiments may include two winding elements 102, such as the edge windings 500 illustrated. Such embodiments have a thermal advantage over an E-E or E-I embodiment as illustrated in FIG. 5 because the effective heat flow section is proportionately larger than with the single winding design. Accordingly, the embodiment in FIG. 12 can usually achieve higher power densities than the embodiment in FIG. 5.

In embodiments such as those illustrated in FIG. 5 or 12, or other embodiments, one or more gaps 508 (e.g., air gaps) may be provided in the core 506 to increase the reluctance of the magnetic circuit. Other embodiments utilize a core 506 made from a material having a relatively low permeability, likewise to increase the reluctance of the magnetic circuit. These reductions in reluctance can reduce the corresponding inductance of the magnetic device, resulting in an appreciable magnetizing current, desirable in certain applications as known to those skilled in the art.

As illustrated in FIG. 11, embodiments utilizing two or more sets of two or more concentric windings 1100 can enable improved electric coupling between axially adjacent windings and reduced proximity losses in high frequency applications provided appropriate winding transpositions are made. With the interconnections 1108 illustrated in FIG. 11, the flow of circulating currents between parallel connected branches is reduced or minimized.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A magnetic device comprising:

a non-toroidal multi-piece magnetic core;

a preformed winding into which the magnetic core is inserted;

a vessel having a base adapted to conduct heat energy from the magnetic core and the preformed winding; and a cavity in the vessel, the cavity having a first smaller portion having a surface configured to conform with an exterior surface of the magnetic core and a second larger portion having a surface configured to conform with an exterior surface of the preformed winding so that an air gap exists between the cavity and the magnetic core and the winding, the first smaller portion being positioned in the base below the second larger portion so that the magnetic core and the preformed winding are in close proximity to the cavity; and a thermally conductive resin is positioned in the cavity in the air gap between the vessel and the magnetic core and the preformed winding.

2. The magnetic device of claim 1 wherein the winding comprises an edge winding having a generally uniform outer surface.

3. The magnetic device of claim 1 wherein the winding comprises a machined winding having a generally uniform outer surface, and an inner surface configured to generally conform to an outer surface of the magnetic core.

4. The magnetic device of claim 1 wherein the winding comprises two or more concentric winding elements.

5. The magnetic device of claim 1 wherein the winding comprises two or more axially adjacent winding elements.

6. The magnetic device of claim 1 wherein an outer surface of the vessel comprises a plurality of fins.

7. The magnetic device of claim 1 wherein the vessel comprises a coolant cavity configured to transfer heat to a liquid coolant.

8. The magnetic device of claim 1 wherein the vessel comprises a generally flat surface adapted to transfer heat to a cold plate in contact with the generally flat surface.

9. The apparatus of claim 1, wherein the magnetic device comprises a transformer or an inductor.

10. The apparatus of claim 9, wherein the winding comprises a tube having at least one spiral cut.

11. The apparatus of claim 10, wherein the winding has in inner surface adapted to generally conform to an outer surface of the core.

12. The apparatus of claim 5, wherein:

the two or more axially adjacent winding elements comprise a first winding element and a second winding element;

the first winding element comprises a first inner winding element concentric with a first outer winding element; and the second winding element comprise a second inner winding element concentric with a second outer winding element, wherein the first inner winding element is electrically coupled to the second outer winding element and the first outer winding element is electrically coupled to the second inner winding element.

13. The apparatus of claim 1, wherein the resin comprises a thermally conductive resin having a thermal conductivity greater than about 0.5 W/(m·K).

14. The apparatus of claim 1, wherein the resin deforms at least 5% without yielding.

15. A system for cooling a non-toroidal magnetic component comprising a preformed winding and a multi-piece core inserted into the winding, the system comprising:

a thermally conductive potting cup having a base and an inner surface having two different sizes adapted so that a first size conforms to at least a portion of the magnetic component and a second size conforms to at least a portion of the preformed winding, wherein the magnetic component is in the potting cup such that said portion of the magnetic component fits in the inner surface in the first size and at least a portion of the preformed winding fits in the second size below the first size;

a thermally conductive resin in the potting cup, between the inner surface and the magnetic component; and a cold plate or heat sink adjacent the base for transferring thermal energy away from the potting cup.

* * * * *